United States Patent [19]

Kaneko et al.

[11] Patent Number: 4,527,616

[45] Date of Patent: Jul. 9, 1985

[54] HORIZONTAL CONTINUOUS CASTING INSTALLATION

[75] Inventors: Hideo Kaneko; Hatsuyoshi Kumashiro; Akira Iwata, all of Kobe, Japan

[73] Assignee: Kawasaki Jukogyo Kabushiki Kaisha, Kobe, Japan

[21] Appl. No.: 390,712

[22] Filed: Jun. 21, 1982

[30] Foreign Application Priority Data

Jun. 25, 1981 [JP] Japan ..... 56-99141

[51] Int. Cl.[3] ..... B22D 27/02; B22D 11/10

[52] U.S. Cl. ..... 164/502; 164/440; 164/268

[58] Field of Search ..... 164/466, 467, 440, 490, 164/500, 498, 502, 147.1, 268

[56] References Cited

U.S. PATENT DOCUMENTS 3,987,840 10/1976 Birat ..... 164/466
4,146,078 3/1979 Rummel et al. ..... 164/467
4,456,054 6/1984 Henders ..... 164/440 X

FOREIGN PATENT DOCUMENTS 49-25808 7/1974 Japan ..... 164/440
54-61032 5/1979 Japan ..... 164/440
774781 10/1980 U.S.S.R. ..... 164/440

*Primary Examiner*—Kuang Y. Lin
*Attorney, Agent, or Firm*—Jordan and Hamburg

[57] ABSTRACT

A horizontal continuous casting installation, particularly for casting a strand of a large transverse dimension, wherein a body of molten metal stored in a tundish is continuously supplied through a tundish nozzle secured to the tundish in the vicinity of its bottom and extending horizontally therefrom to a mold connected to the forward end of the tundish nozzle and arranged coaxially therewith to cast a strand which is continuously withdrawn horizontally from the mold. The mold has an inner transverse dimension greater than the inner transverse dimension of the tundish nozzle. An electromagnetic field generating device is located between an outer surface of the tundish nozzle and an inner surface of the mold in the vicinity of an end surface of the mold facing the tundish nozzle for exerting an electromagnetic force on the body of molten metal flowing from the tundish nozzle to the mold in such a manner that the electromagnetic force is oriented toward the center of the body of molten metal.

11 Claims, 11 Drawing Figures

HORIZONTAL CONTINUOUS CASTING INSTALLATION

This invention relates to a horizontal continuous casting installation for continuously feeding molten metal stored in a tundish through a tundish nozzle secured horizontally to a side wall of the tundish in the vicinity of its bottom to a mold connected to the forward end of the tundish nozzle and arranged coaxially therewith to thereby cast the molten metal in the mold and continuously withdraw from the mold a strand formed therein, and more particularly it is concerned with a horizontal continuous casting installation suitable for producing a strand of a large cross-sectional area.

When a tundish nozzle of the same large cross-sectional area as the mold is used for producing a strand of a large cross-sectional area by means of a horizontal continuous casting installation of the aforesaid construction, the following problems would be encountered. An increase in the size of the tundish nozzle would cause an increase in the area to be cooled, thereby causing a body of molten metal flowing through the tundish nozzle to be readily cooled. It would take time to cool a large cross-sectional area and the speed at which a strand is withdrawn from the mold would be reduced. This would reduce the flow velocity of a molten metal through the tundish nozzle. These factors would combine to produce a shell of solidified molten metal on the inner surface of the tundish nozzle which would tend to be deposited thereon. A production of the shell of solidified molten metal on the inner surface of the tundish nozzle would accelerate solidification of a portion of the molten metal adjacent thereto and the solidified molten metal would become contiguous with a shell of molten metal to be formed in the mold. The result of this would be that the shell of solidified molten metal would be ruptured when the strand is withdrawn from the mold, to give rise to what is referred to as a breakout. A tundish nozzle of a large size is difficult to produce. Thus in the prior art, it has hitherto been impossible to produce a strand of a large cross-sectional area by horizontal continuous casting techniques.

This invention has been developed for the purpose of obviating the aforesaid problems of the prior art. Accordingly the invention has as its object the provision of a horizontal continuous casting installation capable of producing a strand of a large cross-sectional area without a concomitant production of a shell of solidified molten metal on the inner surface of the tundish nozzle.

The aforesaid object can be accomplished according to the invention by providing a horizontal continuous casting installation with a tundish nozzle which is smaller in transverse dimension than the mold, and electromagnetic field generating means located between the outer surface of the tundish nozzle and the inner surface of the mold in the vicinity of an end surface of the mold facing the tundish nozzle, such electromagnetic field generating means being operative to produce an electromagnetic force oriented toward the mold which acts on a body of molten metal supplied from the tundish nozzle to the mold, to thereby prevent the molten metal supplied to the mold from leaking through a gap between the outer surface of the tundish nozzle and the inner surface of the mold to enable casting to be performed smoothly by the mold. According to the invention, another electromagnetic field generating means is located in the vicinity of an end portion of the tundish nozzle on the mold side and produces an electromagnetic force directed toward the center of a body of molten metal flowing through the tundish nozzle, to thereby reduce the transverse dimension of the body of molten metal flowing through the tundish nozzle. The invention also provides lubricant supply means on the inner surface of the tundish nozzle close to the mold to supply lubricant to the surface of the body of molten metal to form a film of lubricant on the surface of the body of molten metal to avoid friction between the surface of the body of molten metal and the surface of the mold, and at the same time to prevent oxidation of the outer periphery of the body of molten metal exposed to atmosphere.

Figure 2:
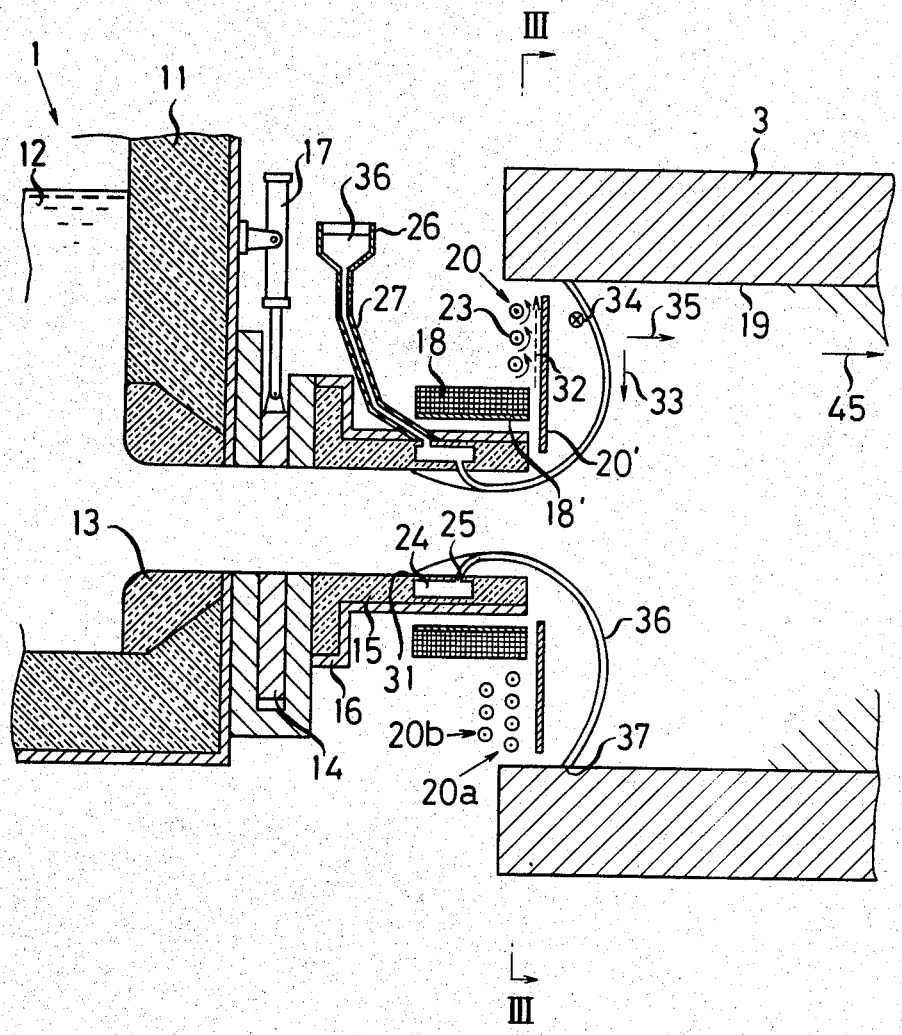
FIG. 2 is a vertical sectional view of the horizontal continuous casting installation comprising one embodiment of the invention, showing the tundish nozzle and a part of the mold.
Figure 4:
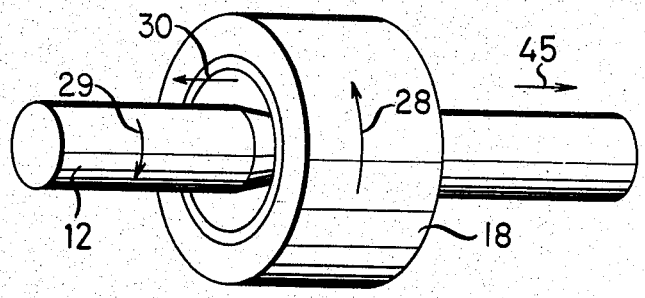
Figure 4A:
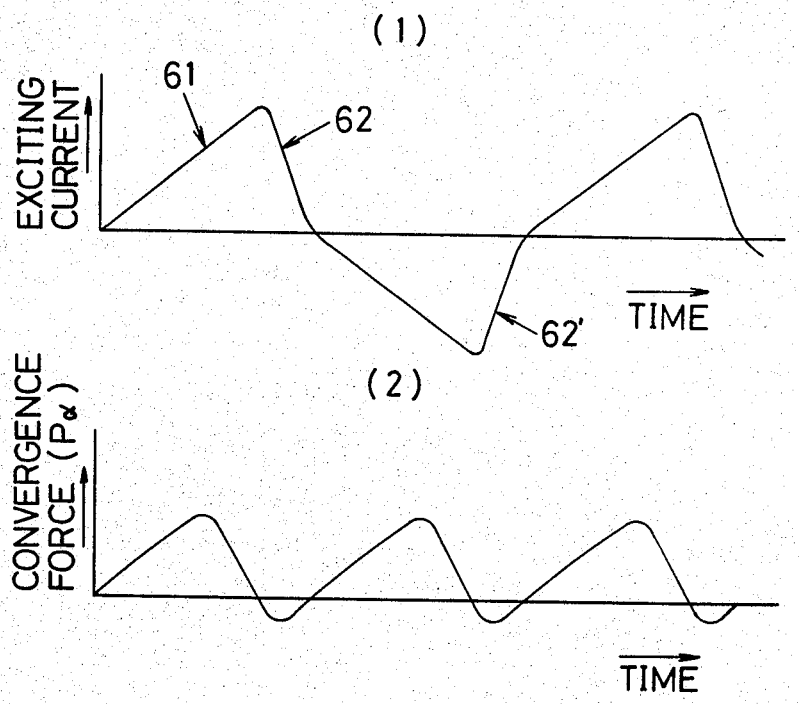

FIGS. 4 and 4*a* are schematic views in explanation of the action of the electromagnetic field generating means shown in FIG. 2; and FIGS. 5–10 are vertical sectional views of other embodiments of the invention.

Figure 1:
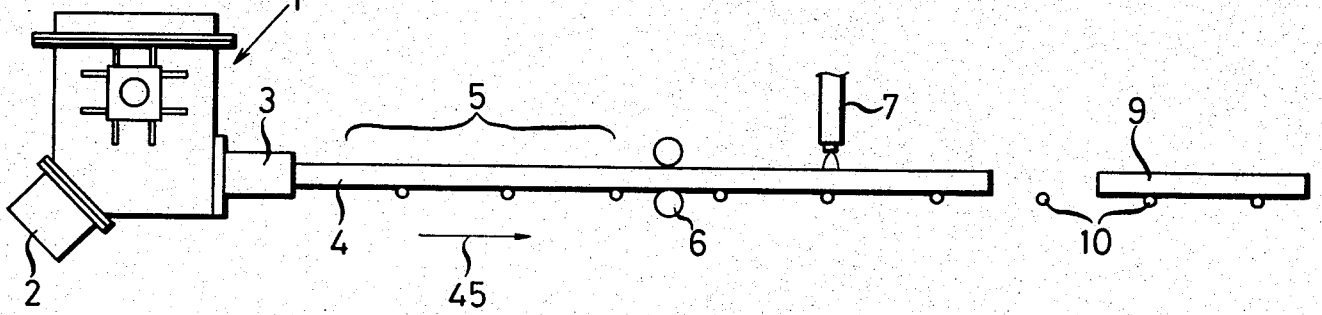
FIG. 1 is a schematic side view of one example of a horizontal continuous casting installation in its entirety.

FIG. 1 shows in a schematic side view of one example of a horizontal continuous casting installation suitable for producing steel ingots of a large transverse dimension, shown in its entirety. A tundish 1 storing a body of molten steel therein is equipped with a heating device 2 for stabilizing the temperature of the body of molten metal. Associated with the tundish is a mold 3 for casting a strand 4 of a large cross-sectional area which is withdrawn from the mold 3 by withdrawing means 6 through a cooling zone 5 in a withdrawing direction 45. The strand 4 is then cut by a cutting device into an ingot 9 which is conveyed by a roller table 10.

FIG. 2 is a sectional view showing on an enlarged scale the vicinity of the boundary between a tundish nozzle 15 and a mold 3 of one embodiment of the horizontal continuous casting installation in conformity with the invention. The tundish 1 has a lining 11 of refractory material for storing a body of molten metal 12 therein. The tundish 1 is formed with a nozzle opening 13 provided with a sliding gate 14 to allow the body of molten metal 12 to flow therethrough out of the tundish 1 or to block the flow of the molten metal 12 therethrough. The molten metal released from the tundish 1 through the nozzle opening 13 and sliding gate 14 is led through the tundish nozzle 15 of refractory material into the mold 3. The tundish nozzle 15 is firmly secured by a mounting member 16 to the tundish 1. The sliding gate 14 is driven by a drive cylinder 17.

Electromagnetic field generating means 18 in the form of a coil having a wire wound in convolutions and arranged in a manner to enclose the tundish nozzle 15 is located in the vicinity of an end portion of the tundish nozzle 15 close to the mold 3. The electromagnetic field generating means 18 produces an electromagnetic force which acts on a body of molten metal 12 flowing through the tundish nozzle 15 to have its transverse dimension reduced or converged in going toward the boundary between the tundish nozzle 15 and the mold 3 which is connected to the tundish nozzle 15 coaxially therewith. The mold 3 has an inner transverse dimension which is greater than an outer transverse dimension of the tundish nozzle 15, and an inner peripheral surface 19 spaced apart radially outwardly of an outer peripheral surface of the tundish nozzle 15. Another electromagnetic field generating means 20 is located in a plane substantially at a right angle to the direction 45 in which the strand 4 is withdrawn in the vicinity of the boundary between the tundish nozzle 15 and the mold and between the inner peripheral surface of the mold 3 and the outer peripheral surface of the tundish nozzle 15. The body of molten metal introduced into the mold 3 begins to solidify in the mold 3 which is cooled as by cooling water and the thickness of the solidified layer of molten metal increases with time.

Figure 3:
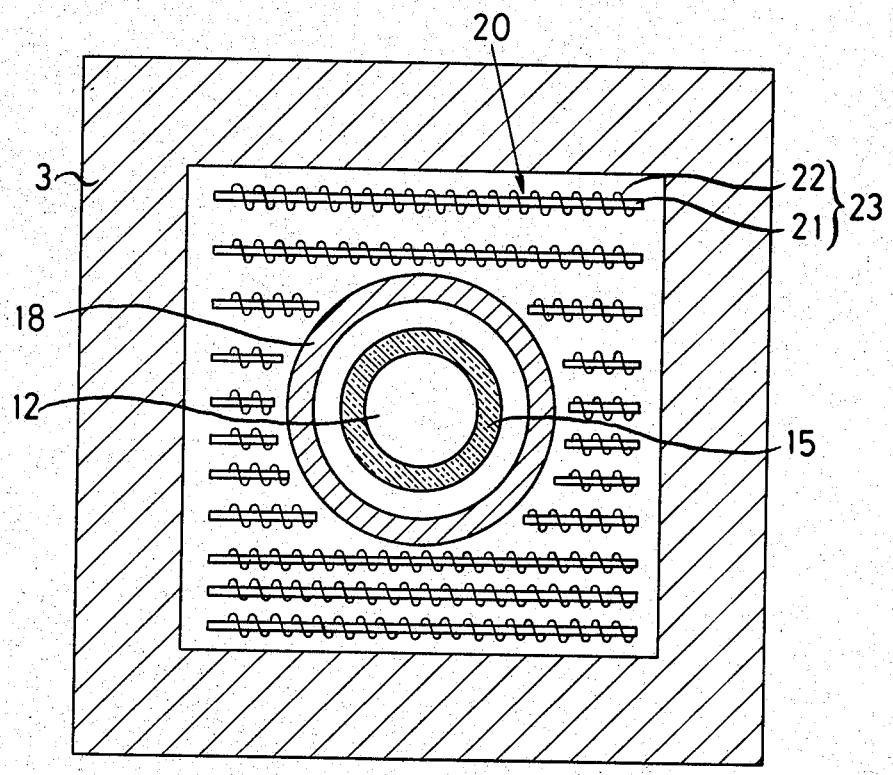
FIG. 3 is a sectional view taken along the line III—III in FIG. 2.

FIG. 3 is a sectional view taken along the line III—III in FIG. 2. The electromagnetic field generating means 20 comprises electromagnetic field generating elements 23 each including a core 21 horizontally extending at a right angle to the axis of the mold 3 and having a wire 22 wound in convolutions thereon. The electromagnetic field generating elements 23 are vertically spaced apart to be parallel to each other in such a manner that they are spaced apart from one another by a smaller distance or in closer proximity to one another in a lower portion of the mold 3 than in an upper portion thereof.

The tundish nozzle 15 is formed with a header 24 at a portion of the tundish nozzle 15 in a zone of action of the electromagnetic field generating means 18 in a manner to extend along the entire inner peripheral surface thereof. The header 24 has a nozzle 25 opening radially inwardly of the tundish nozzle 15 and extending along the entire periphery of the tundish nozzle 15. A lubricant 36 is supplied from a storage tank 26 through a conduit 27 to the header 24. The lubricant 36 supplied to the header 24 contains as its main constituent CaO, $SiO_2$ or $AL_2O_3$ in powder form added with powder of ferromagnetic material, such as pure iron or cobalt. The lubricant 26 may contain as its main constituent rapeseed oil added with powder of ferromagnetic material, such as pure iron or cobalt.

FIG. 4 is a view in explanation of the manner in which a body of molten metal 12 flowing through the tundish nozzle 15 has its transverse dimension reduced or is converged in going toward the boundary between the tundish nozzle 15 and the mold by electromagnetic field generating means 18. The body of molten metal 12 flows in the direction 45 in which the strand 4 is withdrawn from the mold 3. As an AC current is passed to the convolutions of wires of the electromagnetic field generating means 18 to flow in the direction of an arrow 28, an eddy current is produced in the molten metal 12 and flows in a direction 29 opposite the direction 28 in accordance with a changing rate of the current when an energizing current increases along a curve 61 shown in FIG. 4*a*(1). The current flowing in the direction 28 through the convolutions of wires of the electromagnetic field generating means 18 causes a magnetic field to be generated in the direction of an arrow 30, so that an electromagnetic force oriented radially inwardly of the body of molten metal 12 is generated by the magnetic field and acts on the body of molten metal 12 along the entire periphery thereof.

Meanwhile when the energizing current decreases along a curve 62 shown in FIG. 4*a*(1), the eddy current 29 is reverse in direction and acts as a diverging force on the body of molten metal 12. In order to suppress the action of the diverging force on the body of molten metal as much as possible, it has hitherto been usual practice to distort the wave form of an energizing current as shown in FIG. 4*a*(1) to increase the changing rate of the energizing current only in a region of the curve 62, in spite of an AC current being of sine wave form. By using this wave form for the energizing current, it is possible to absorb the component of the region of the curve 62, when an induced current absorbing plate 18' of the electromagnetic field generating means 18 or the tundish nozzle mounting member 16 shown in FIG. 2 is formed of material, such as copper, which is low in electric resistivity. As a result, a converging force is exerted on the body of molten steel as measured by a mean time of one cycle, as shown in FIG. 4*a*(2).

In FIG. 4*a*(1), an induced current flows on the surface of the body of molten metal in a direction opposite the direction of the arrow 29 shown in FIG. 4 in a region along curve 62 and 62', so that a negative converging force acts thereon. In the region along the curves 62 and 62' in which the current shows a great change in value, the greater the change in the energizing current, the more readily is the induced current absorbed by the molten metal or the wall of the mold. Thus, if the region along the curves 62 and 62' shown in FIG. 4*a*(1) is reduced in length, the need to provide the induced current absorbing plate 18' inside the electromagnetic field generating means 18 can be eliminated. The induced current absorbing plate 18' is intended to positively absorb an induced current in the region along the curves 62 and 62'.

Thus by virtue of the electromagnetic field generating means 18, it is possible to reduce the transverse dimension of the body of molten metal 12 flowing through the tundish nozzle 15.

Referring to FIG. 2 again, the nozzle 25 for supplying the lubricant 36 is located anterior to a position 31 in which the molten metal 12 is released from the inner peripheral surface of the tundish nozzle 15 (a rightward part of FIG. 2) with respect to the direction 45 in which the strand 4 is withdrawn from the mold 3. Thus the lubricant 36 is supplied from the nozzle 25 to the outer peripheral surface of the body of molten metal 12 and not introduced into the molten metal 12.

The lubricant 36 contains ferromagnetic powder, so that the lubricant 36 is kept from separating itself from the surface of the body of molten metal 12 and can be deposited thereon stably.

In another electromagnetic field generating means 20, as a current flowing in the direction of an arrow 32 through the convolutions of wires 22 of the electromagnetic field generating elements 23 increases in value, an eddy current flowing in a direction indicated by an arrow 33 opposite the direction of the arrow 32 is produced in the molten metal 12 in the mold 3. As the current flows in the direction of arrow 32 through the convolutions of wires 22, a magnetic field directed beyond the plane of FIG. 2 is produced as indicated by the numeral 35. Thus an electromagnetic force is produced in the molten metal 12 in the mold 3 directed in the same direction as the direction 45 in which the strand 4 is withdrawn from the mold 3, as indicated by an arrow 35. Thus the body of molten metal 12 having its transverse dimension reduced by the electromagnetic field generating means 18 in the tundish nozzle 15 is diverged radially outwardly in the mold 3 and receives an electromagnetic force generated by the electromagnetic field generating means 20 in a position anterior to the boundary between the tundish nozzle 15 and the mold 3 with respect to the strand withdrawing direction 45, so that leaks of molten metal 12 through the gap between the inner surface of the mold 3 and the outer surface of the tundish nozzle 15 can be avoided. Thus the molten metal 12 can be cast by the mold 3 into the strand 4.

The lubricant 36 deposited on the outer periphery of the body of molten metal 12 after being supplied through the nozzle 25 forms a film in a position 37 in which the outer periphery of the body of molten metal 12 is brought into contact with the inner peripheral surface 19 of the mold 3 to avoid friction therebetween and to avoid oxidation of a portion of the molten metal 12 exposed to atmosphere. Thus casting of the strand 4 of a large cross-sectional area is made possible.

The electromagnetic field generating elements 23 are arranged such that they are closely spaced from one another or arranged with higher density in the lower portion of the mold 3 than in the upper portion thereof. This increases the electromagnetic force oriented in the direction of the arrow 35 and exerted on the lower portion of the body of molten metal 12 as compared with the electromagnetic force exerted on the upper portion of the body of molten metal 12. Thus the difference in static pressure between the upper portion and the lower portion of the body of molten metal 12 is compensated, and the molten metal 12 is brought into contact with the inner peripheral surface 19 of the mold 3 and solidifies under the same condition through the entire periphery of the body of molten metal 12, thereby enabling the quality of the strand 4 to be increased. When necessary, the electromagnetic field generating elements 23 may be arranged in a plurality of layers (two layers 20*a* and 20*b* in this embodiment) along the strand withdrawing direction 45. The electromagnetic field generating elements 23 of the layers 20*a* and 20*b* are displaced vertically in a vertical plane. This is conducive to a further reduction in the number of irregularities on the surface of the body of molten metal 12 in the mold 3, thereby enabling the lubricant 36 to be uniformly deposited on the entire surface of the body of molten metal 12.

Figure 5:
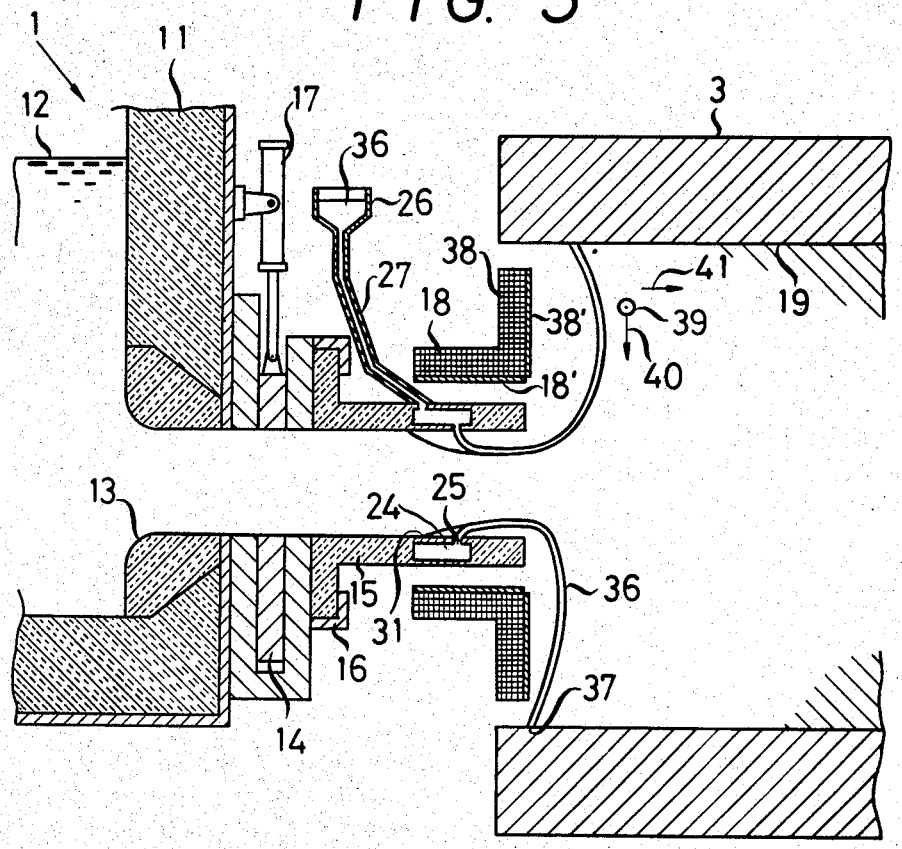

FIG. 5 is a sectional view of another embodiment in which parts similar to those shown in FIG. 2 are designated by like reference characters. What is noteworthy is that still another electromagnetic field generating means 38 cooperating with the electromagnetic field generating means 18 is mounted in a manner to enclose the tundish nozzle 15. Unlike the electromagnetic field generating means 20 described by referring to FIGS. 2 and 3, the electromagnetic field generating means 38 is constructed such that convolutions of a wire are wound annularly in a vertical plane to form a coil about the axis of the mold 3 in the vicinity of the end surface of the mold 3 facing the tundish nozzle 15, and an induced current absorbing plate 38' is attached to the side of the electromagnetic field generating means 38 facing the mold 3. As a current is passed to the wire of the electromagnetic field generating means 38 at its upper portion in a direction perpendicular to the plane of FIG. 5 and toward the back of the plane of FIG. 5, an eddy current designated by the numeral 39 directed away from the plane of FIG. 5 is produced and a magnetic field is produced in the direction of an arrow 40. This creates an electromagnetic force in the molten metal 12 in the mold 3 as indicated by an arrow 41 oriented in the strand withdrawing direction 45.

Figure 6:
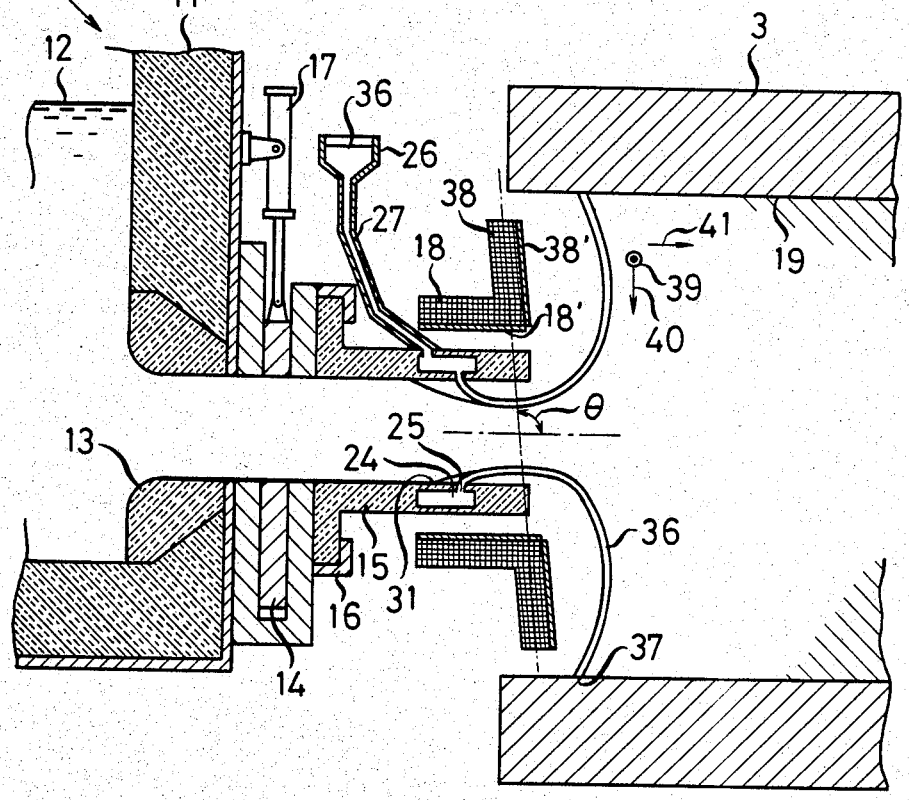

FIG. 6 shows another embodiment. In the embodiment shown in FIG. 5, the body of molten metal 12 shaped by the electromagnetic field generating means 38 has its end surface, lower portion of which bulges toward the tundish nozzle 15 side due to the static pressure differential between its upper and lower portions. Thus the body of molten metal 12 in the mold 3 has different lengths of contact therebetween in the upper and lower portions of the molten metal 12 or different degrees of cooling thereof by the wall of the mold 3, making it impossible to obtain uniform cooling of the molten metal 12. To obviate the aforesaid disadvantage, the electromagnetic field generating means 38 of the embodiment shown in FIG. 6 is obliquely located at an angle $\theta$ with respect to a horizontal plane including the center axis of the body of molten metal 12 in such a manner that the lower the position of the electromagnetic field generating means 38, the more anteriorly is it disposed in the boundary between the tundish nozzle and the mold with respect to the strand withdrawing direction 45. By this arrangement, the lower portion of the body of molten metal 12 receives a greater amount of electromagnetic force than the upper portion thereof in the same vertical plane in the mold 3, with the result that the body of molten metal 12 in the mold is maintained in a plane substantially at right angles to the strand withdrawing direction 45. Thus the condition of solidification of the body of molten metal 12 in a position 37 in which the molten metal 12 is brought into contact with the inner peripheral surface of the mold 3 can be rendered uniform through the entire periphery, and the quality of the strand 4 can be improved. The lubricant 36 can also be uniformly deposited on the peripheral surface of the body of molten metal 12 through the entire periphery.

Figure 7:
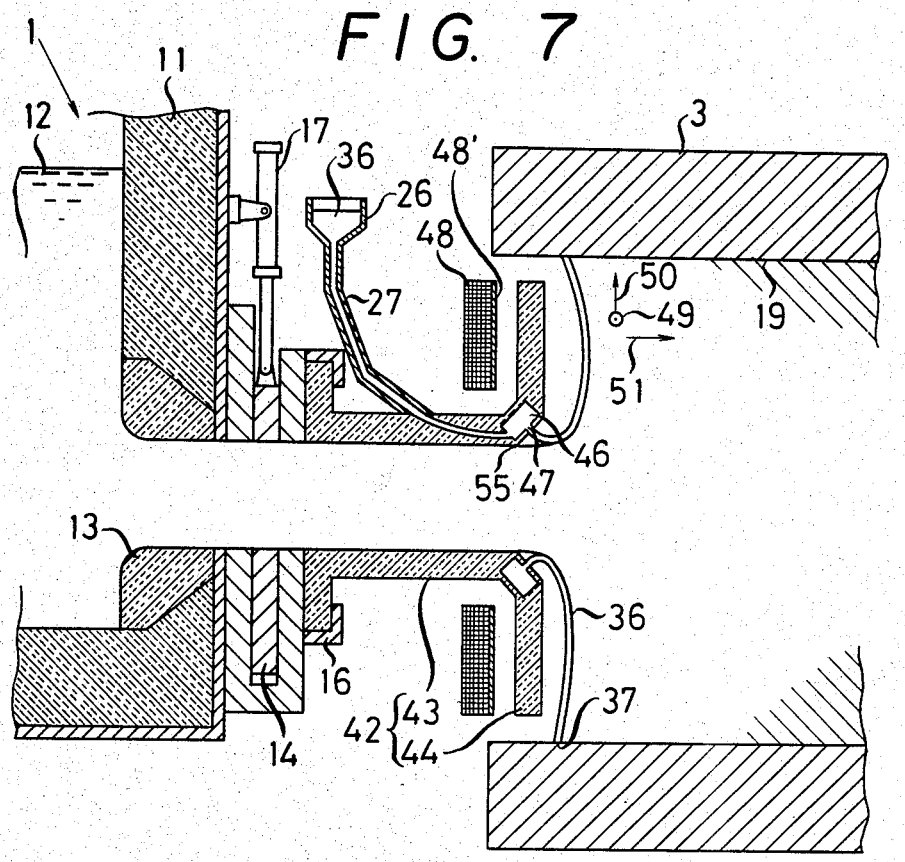

FIG. 7 is a sectional view of still another embodiment, in which a tundish nozzle 42 formed of refractory material comprises a cylindrical portion 43 and a flange 44. Formed in the vicinity of the connection between the cylindrical portion 43 and flange 44 and disposed anteriorly of a position 55 in which the molten metal 12 is released from the cylindrical portion 43 with respect to the strand withdrawing direction 45 is a header 46 which receives a supply of lubricant 36 from the storage tank 36 through the conduit 27. The lubricant 36 in the header 46 is sprayed onto the outer peripheral surface of the body of molten metal 12 through nozzles 47 formed in the header 46. The nozzles 47 are formed on the entire outer periphery of the header 46. Electromagnetic field generating means 48 is in the form of a coil having a wire wound in convolutions at an end surface of the mold 3 about its center axis in a manner to enclose the cylindrical portion 43 of the tundish nozzle 42, and has an induced current absorbing plate 48' located at its end surface facing the mold 3. When a current oriented toward the back of the plane of FIG. 7 is passed to the wire of the electromagnetic field generating means 48 in its upper portion, an eddy current designated by the numeral 49 flows in the body of molten metal 12 and is directed away from the plane of FIG. 7, and at the same time a magnetic field designated by the numeral 50 is generated. This gives rise to an electromagnetic force 51 oriented in the strand withdrawing direction 45 and exerted on the body of molten metal 12. In this embodiment, the body of molten metal 12 does not have its transverse dimension reduced in the tundish nozzle 42, thereby enabling power consumption to be reduced.

Figure 8:
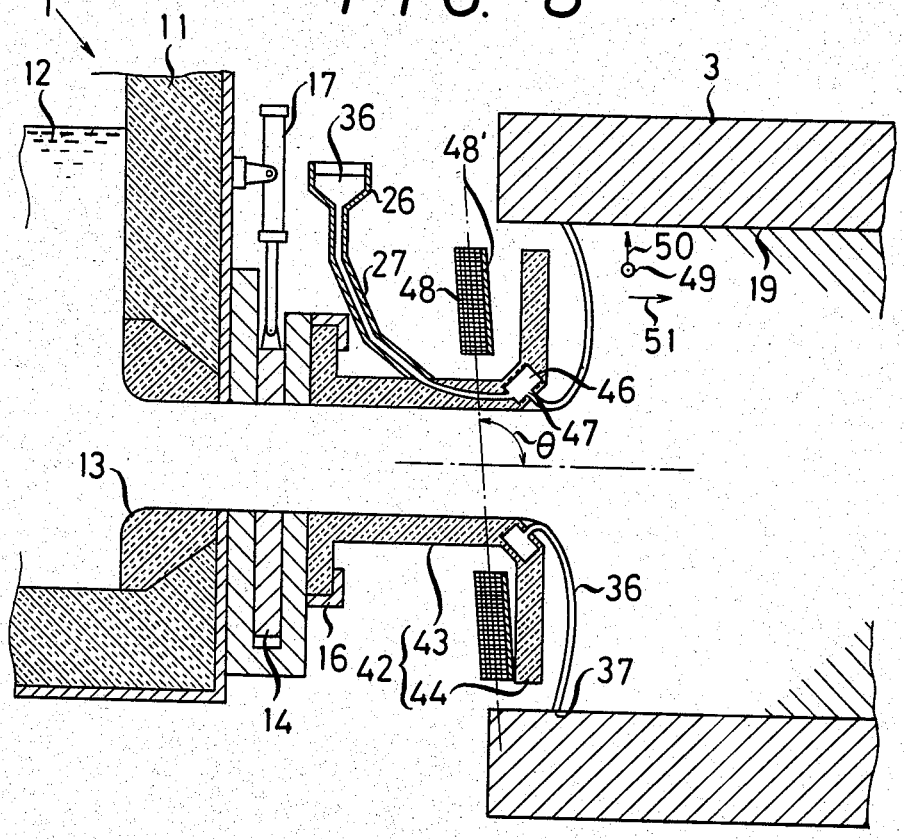

FIG. 8 is a sectional view of still another embodiment which is similar to the embodiment shown in FIG. 7 but distinct therefrom in that the electromagnetic field generating means 48 is obliquely located at an angle $\theta$ with respect to a horizontal plane including the center axis of the body of molten metal 12 in such manner that the lower the position of the electromagnetic field generating means 48, the more closely it is disposed toward the boundary between the tundish nozzle and the mold. By this arrangement, a greater amount of electromagnetic force is given to the lower portion of the body of molten metal 12 in the same vertical plane in the mold 3 than to the upper portion thereof. As a result, the position in which the body of molten metal 12 is initially brought into contact with the inner peripheral surface of the mold 3 is disposed in a plane substantially at right angles to the strand withdrawing direction 45, enabling the lubricant 36 from the nozzle 47 to be deposited on the entire surface of the body of molten metal 12. Moreover, the condition of solidification of molten metal in the position in which the body of molten metal 12 is brought into contact with the inner peripheral surface 19 of the mold 3 is rendered uniform through the entire periphery, and the quality of the strand 4 is improved.

Figure 9:
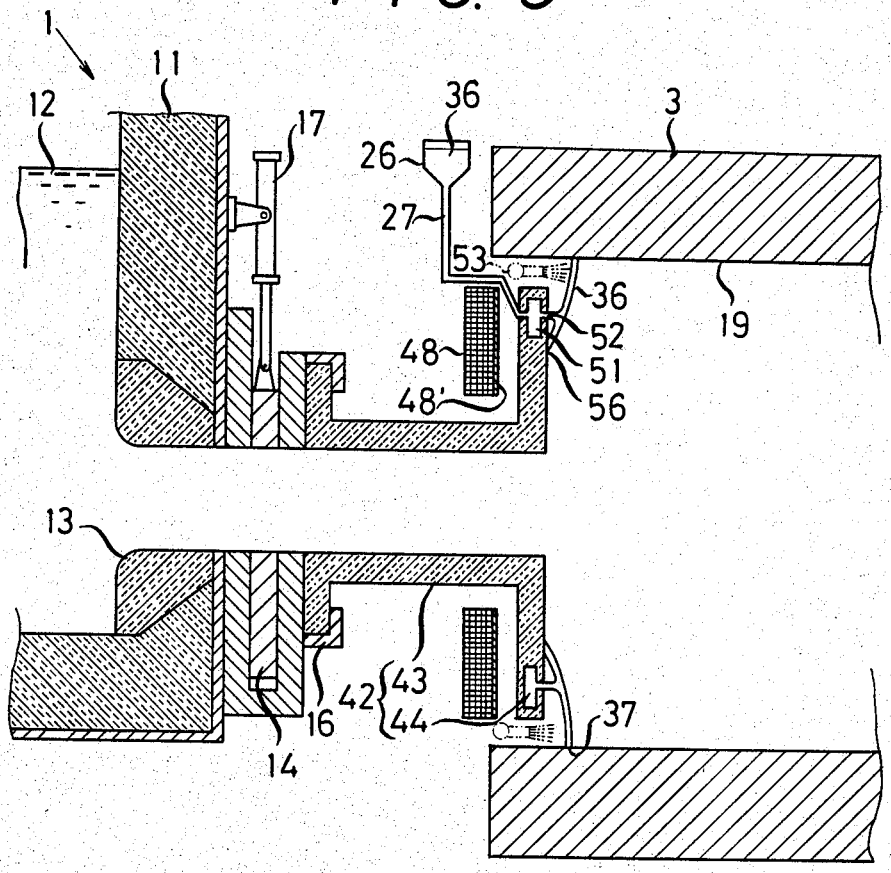

FIG. 9 shows still another embodiment which, although similar to the embodiments shown in FIGS. 7 and 8, is distinct therefrom in that a header 51 for the lubricant 36 is located radially outwardly of the flange 44, and the molten metal 12 is released from the tundish nozzle 42 in a position 56 located radially inwardly of nozzles 52 of the header 51. The radially outward end of the flange 44 is radially spaced apart from the inner peripheral surface of the mold 3 to prevent the flange 44 from being cooled by the cooling mold 3 to keep a shell of solidified molten metal from being formed at the flange 44.

In still another embodiment, a ring-shaped header 53 indicated by an imaginary line in FIG. 9 may be provided so as to eject the lubricant 36 through nozzles formed in the header 53.

Figure 10:
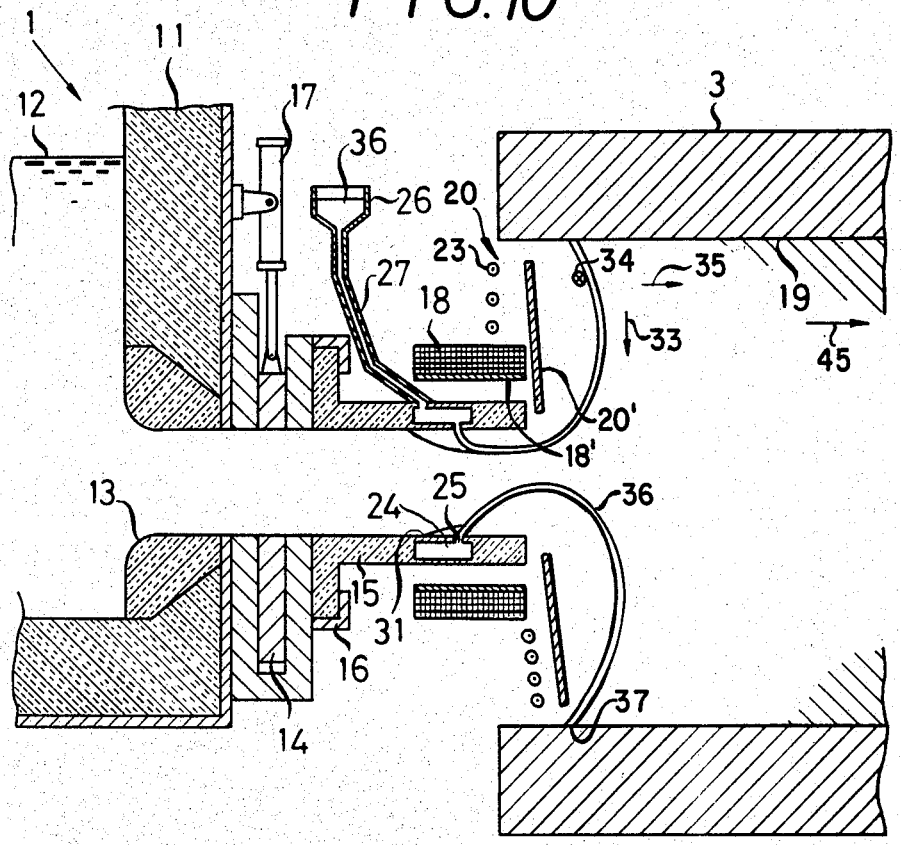

In a further embodiment, the electromagnetic field generating elements 23 of the electromagnetic field generating means 20 of the embodiments shown in FIGS. 2 and 3 may be arranged at an end surface of the mold 3 in a manner to be equidistantly spaced apart from one another and inclined so that the elements in the lower portion of the mold 3 are disposed anteriorly of the elements in the upper portion of the mold 3 with respect to the strand withdrawing direction 45 as shown in FIG. 10, to thereby enable a greater amount of electromagnetic force to be exerted on the lower portion of the body of molten metal 12 in the same vertical plane in the mold than on the upper portion thereof. Also, the electromagnetic field generating elements 23 may be arranged equidistantly from one another and a current of a higher value may be passed to the coils in the lower portion than to the coils in the upper portion, to achieve the same effect. In the embodiments shown in FIGS. 2, 5 and 6, the sliding gate 14 is provided to allow the body of molten metal 12 to flow into the mold 3 and cut off its flow. However, the object can be accomplished by eliminating the sliding gate 14 and by controlling the magnetic field generated by the electromagnetic field generating means 18 or adjusting the position in which the electromagnetic field generating means 18 is mounted.

According to the invention, it is possible to use a mold of a large size to produce a strand of a large cross-sectional area by reducing the size of the tundish nozzle.

We claim:

1. A horizontal continuous casting installation, particularly for casting a strand of a large transverse dimension, comprising:

a tundish for storing a body of molten metal therein;

a tundish nozzle secured to said tundish in the vicinity of its bottom and extending horizontally therefrom; and a mold connected to the forward end of said tundish nozzle coaxially therewith for continuously receiving said body of molten metal from said tundish through said tundish nozzle to cast a strand which is continuously withdrawn therefrom in a horizontal direction, said mold having an inner transverse dimension greater than the inner transverse dimension of said tundish nozzle, wherein the improvement comprises electromagnetic field generating means located between an outer surface of said tundish nozzle and an inner surface of said mold in the vicinity of an end surface of the mold facing said tundish nozzle, said electromagnetic field generating means being disposed adjacent to a substantially vertical plane at a right angle to the center axis of the mold, for exerting an electromagnetic force on the body of molten metal supplied from the tundish through the tundish nozzle to the mold, said electromagnetic force being oriented in a direction toward the mold to move the body of molten metal forwardly.

2. A horizontal continuous casting installation as claimed in claim 1, wherein said electromagnetic field generating means comprises electromagnetic field generating elements each comprising a core horizontally extending at right angles to the axis of said mold, and a wire wound in convolutions on said core, said electromagnetic field generating elements being vertically spaced apart from each other.

3. A horizontal continuous casting installation as claimed in claim 2, wherein said electromagnetic field generating elements are located at higher density in a lower portion than in an upper portion.

4. A horizontal continuous casting installation as claimed in claim 2, wherein said electromagnetic field generating elements has a lower portion arranged in staggered relation in two parallel vertical planes parallel to each other.

5. A horizontal continuous casting installation as claimed in claim 1, wherein said electromagnetic field generating means is in the form of a coil including a wire wound in convolutions around said mold in a manner to spread in a plane substantially at right angles relative to the center axis of said mold.

6. A horizontal continuous casting installation as claimed in claim 5, wherein said coil is slightly inclined with respect to the center axis of said mold in such a manner that a lower portion of the coil is disposed anteriorly to an upper portion thereof with respect to a direction in which the strand is withdrawn from the mold.

7. A horizontal continuous casting installation as claimed in claim 2, wherein said electromagnetic field generating elements are arranged vertically and equidistantly spaced apart from one another and located in an inclined plane in such a manner that the electromagnetic field generating elements in a lower portion are located anteriorly to the electromagnetic field generating elements in an upper portion with respect to a direction in which the strand is withdrawn from the mold.

8. A horizontal continuous casting installation as claimed in claim 7, further comprising another electromagnetic field generating means located in the vicinity of an end portion of said tundish nozzle facing said mold for exerting an electromagnetic force on the body of molten metal flowing through the tundish nozzle in such a manner that the electromagnetic force is oriented toward the center of the body of molten metal, and lubricant supply means located on an inner surface of said tundish nozzle facing said mold.

9. A horizontal continuous casting installation as claimed in claim 5 or 6, wherein said tundish nozzle includes an outwardly extending flange formed at an end portion thereof facing the mold, and further comprising lubricant supply means located at said flange.

10. A horizontal continuous casting installation, comprising a container having a bottom for storing a body of molten metal therein;

a nozzle secured to the container near the bottom and extending substantially horizontally therefrom, said nozzle having a forward end;

a mold situated at the forward end of the nozzle coaxially therewith for continuously receiving the body of molten metal from the container through the nozzle to cast a strand, said mold having a rear end facing the forward end of the nozzle, an inner transverse dimension of the mold being larger than that of the nozzle so that a gap is formed between the forward end of the nozzle and the rear end of the mold, and electromagnetic field generating means situated in the gap between the forward end of the nozzle and the rear end of the mold and disposed adjacent to a substantially horizontal plane parallel to the center axis of the mold, said electromagnetic field generating means being energized with an energizing current having an asymmetrical wave form in a plot of absolute current value on a y-axis against time on an x-axis, the absolute value of the slopes of the waves being less on the portions of the waves of increasing absolute current values than on the portions of the waves of decreasing absolute current values, the body of the molten metal in the mold being continuously moved forwardly by said electromagnetic field generating means.

11. A horizontal continuous casting installation according to claim 10, further comprising lubricant supply means situated on an inner surface of the nozzle at the forward end thereof, the lubricant supply means supplying lubricant to the body of molten metal passing through the nozzle.

* * * * *